US005418978A

United States Patent [19]

Hochman

[11] Patent Number: 5,418,978

[45] Date of Patent: May 30, 1995

[54] PROTECTIVE GARMENT FOR THE MENTALLY DISABLED

[76] Inventor: Sanford Hochman, 1731 Briggs Chaney Rd., Silver Spring, Md. 20905

[21] Appl. No.: 254,870

[22] Filed: Jun. 6, 1994

[51] Int. Cl.[6] ..... A41D 13/00; A41D 13/02

[52] U.S. Cl. ..... 2/69; 2/46; 2/76; 2/80; 2/114; 2/237

[58] Field of Search ..... 2/46, 48, 49.1, 49.2, 2/49.3, 49.4, 49.5, 69, 69.5, 76, 82, 84, 75, 80, 114, 237; 24/336, 306, 265 H, 601.4; 40/1.5, 1.6, 580, 649, 661

[56] References Cited

U.S. PATENT DOCUMENTS

| | | | |
|---|---|---|---|
| Re. 34,763 | 10/1994 | Tucker | 2/69.5 X |
| 2,675,557 | 4/1954 | Kempner, Jr. | 2/114 |
| 3,159,891 | 12/1964 | Brewer | 24/601.4 |
| 3,988,781 | 11/1976 | Horan | 2/114 X |
| 4,259,797 | 4/1981 | Belser | 40/1.5 |
| 4,304,006 | 12/1981 | Swart | 2/80 X |
| 4,718,124 | 1/1988 | Sawicki et al. | 2/114 |
| 4,754,500 | 7/1988 | Brucato et al. | 2/114 |
| 5,048,122 | 9/1991 | Prieur | 2/69 |
| 5,146,626 | 9/1992 | Rosado | 2/105 |
| 5,208,918 | 5/1993 | Royal | 2/69 X |

*Primary Examiner*—Jeanette E. Chapman
*Attorney, Agent, or Firm*—Robert Halper

[57] ABSTRACT

A one piece washable garment having high thermal qualities and designed as a restraint for old and incapacitated people. The garment is closed at the front except for a small but concealed cavity at the waistline to house a catheter tube. A sheath for accessories is stitched to the underside of the front of the garment. The rear of the garment is divided into two segments held together by a plurality of fasteners, one of which extends from near the neckline to the crotch.

9 Claims, 2 Drawing Sheets

PROTECTIVE GARMENT FOR THE MENTALLY DISABLED

FIELD OF THE INVENTION

This invention relates to garments that are designed to keep a mentally incapacitated individual from tearing off or removing his clothes on impulse, while at the same time allowing complete freedom of movement and comfort. Additionally the garment of this invention has a number of useful accessories not found in previously designed garments of this type.

The garments that are presently to be described have utility in mental institutions, nursing homes and even in domestic settings where the caretaker might be a member of the family.

DESCRIPTION OF THE PRIOR ART

U.S. Pat. No. 3,911,499 shows a disposable medical gown, used by hospital staff, made from a single piece of fabric with no seams at the front that would provide openings for bacterial contamination. Seams in the back are held together by self attaching strips.

U.S. Pat. No. 4,309,006 is a coverall garment for toddlers. The garment is one piece and opened only at the back by means of a draw string. Additionally, there is a foundation liner made of a lightweight material such as cotton. Bonded to the liner is an absorbent layer of material such as paper used in diapers. The absorbent layer extends across the front and the seat and crotch on the underside. The garment is a substitute for a bib to be used at mealtime.

U.S. Pat. No. 4,660,226 is an example of a disposable bib which can be used in garments for babies and adults and serves as a protective covering for clothing. The bib has an absorbent layer and a waterproof layer with adhesive strips for securing the absorbent layer to the waterproof layer.

U.S. Pat. No. 5,048,122 is a garment for shielding lines connected to a patient such as a small child. The garment is made of soft cotton and includes an undercrotch portion 13 and a flap 14 sewn thereto. The flap passes beneath the crotch and connects to the back 20 of the garment by a hook and eye assembly. The back is opened by a zipper that extends from the neck to a region just above the leg openings 32. When the zipper is closed at the top, end flaps *22a, 22b* are pulled together. The zipper is hidden beneath a tab 23 sewn to one side of the garment and fixed to the other side by a fastener 24 having hooks *24h* and eyes *24e*. Such an arrangement prevents small children from opening the tab at the neck. Likewise the zipper could not be pulled down, nor could the flap be separated and pulled down. Thus the child can not reach within the garment and have access to a pocket 16 positioned below the site of a catheter implant from which a catheter tube extends down towards the pocket. The pocket is a double walled structure 34 sewn at the bottom and both side edges to an inside front surface 35 through a hem 37 at the bottom and along the sides. The pocket limits the motion of the catheter and the garment being tight fitting prevents the child from pulling the catheter out of the pocket.

U.S. Pat. No. 5,208,918 is akin to the present invention, but lacks many of the features and accessories of the invention. It is designed for restraining a person such as those in nursing homes and mental institutions from taking the garments off. The garment is described as completely unslotted in the front and has pockets on each side. It is opened from the rear by means of a slide fastener that extends from just below the neck to a region above the pelvis. The lower part of the garment has a continuous slot 15 extending over the leg covering portions 4,11,5,12 between front 1 and rear 8. When a wearer has to go the bathroom, this slot is opened by a staff member by moving the slide fastener 16 located at the bottom of one of the legs.

U.S. Pat. No. 5,241,708, shows a three ply liner attached to the interior of the garment with a disposable absorbent pad removably attached to the interior of the liner. Additionally the waist band has gathered portions resulting from two symmetrically disposed front waist band elastic segments interior to a waist band cover.

U.S. Pat. No. 5,257,951 shows a post mastectomy garment having gathering 56 at the waist and the same encloses an elastic band to provide a tight fit.

Accordingly it is an object of this invention to produce a restraining garment for individuals in nursing homes and mental institutions who are elderly and/or mentally incapacitated.

It is a further object of this invention to provide such a garment that does not restrain mobility and is comfortable to wear.

It is still an object of this invention to provide a garment that is easily washable and provides sufficient warmth in the event that an individual will remove his bed covers at night.

It is also an object of this invention to provide the garment with a number of accessories which assist personnel in easy removal of the garment as well as providing access to concealed maintenance facilities.

SUMMARY OF THE INVENTION

While the garment of this invention has multifold purposes first and foremost it is a non restraining garment designed to inhibit disrobing without loss of freedom of movement and is intended for the mentally incapacitated, although obviously it is not limited to this group. In this respect it is a one piece garment completely closed at the front except for openings at the limbs and neck. It is essentially loose fitting but for the waist region which is elasticized and contains a concealed opening for storage of a catheter tube. The garment is made of material which has high thermal qualities and is easily washable. The garment provides easy access at the rear for personnel to remove the garment or reach in and extract an accessory located in the inner front. A detachable bib at the neck helps to prevent soiling at mealtime.

DETAILED DESCRIPTION OF THE INVENTION

Figure 1:
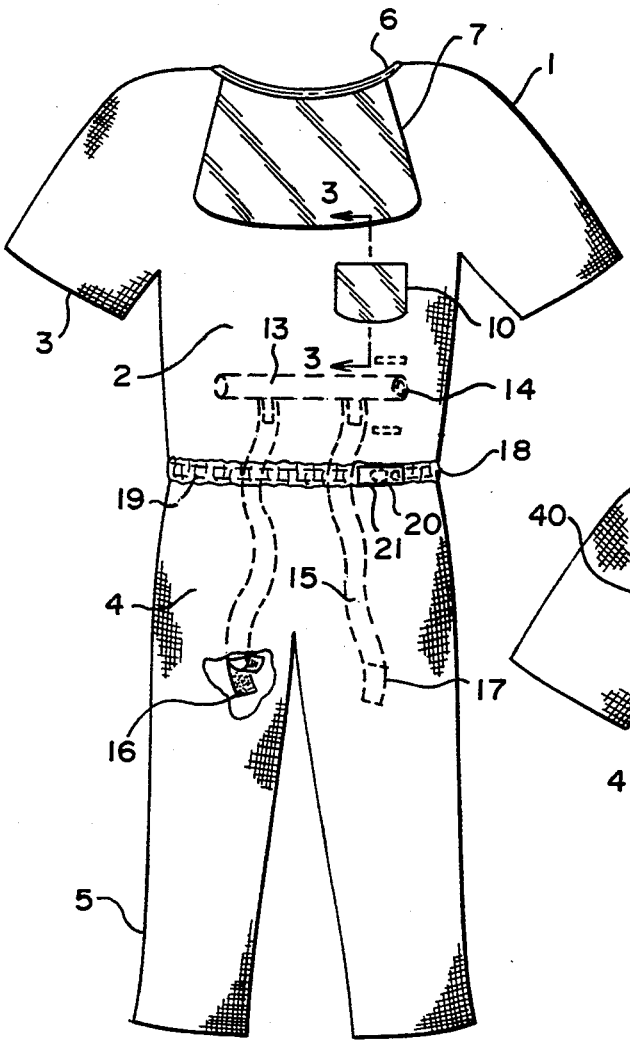
FIG. 1 is a front view of the garment.
Figure 3:
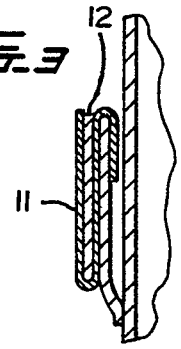
FIG. 3 is a cross sectional view taken on line 3—3 of FIG. 1.
Figure 2:
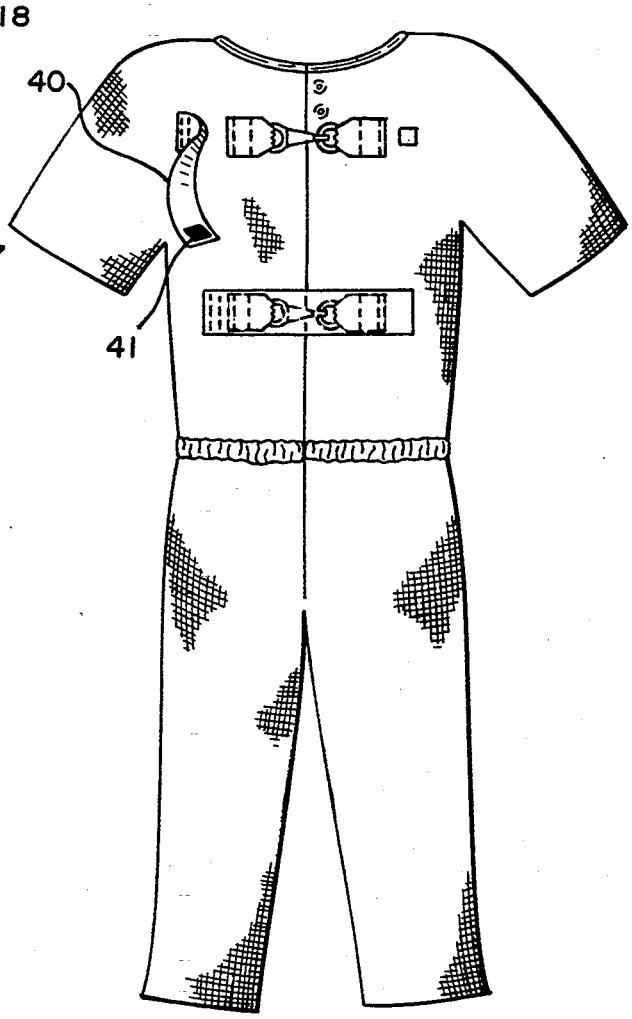
FIG. 2 is a rear view of the garment.
Figure 4:
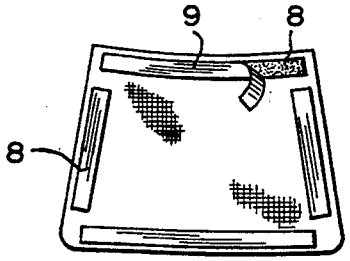
FIG. 4 is a partial rear view of the bib in FIG. 1.
Figure 5:
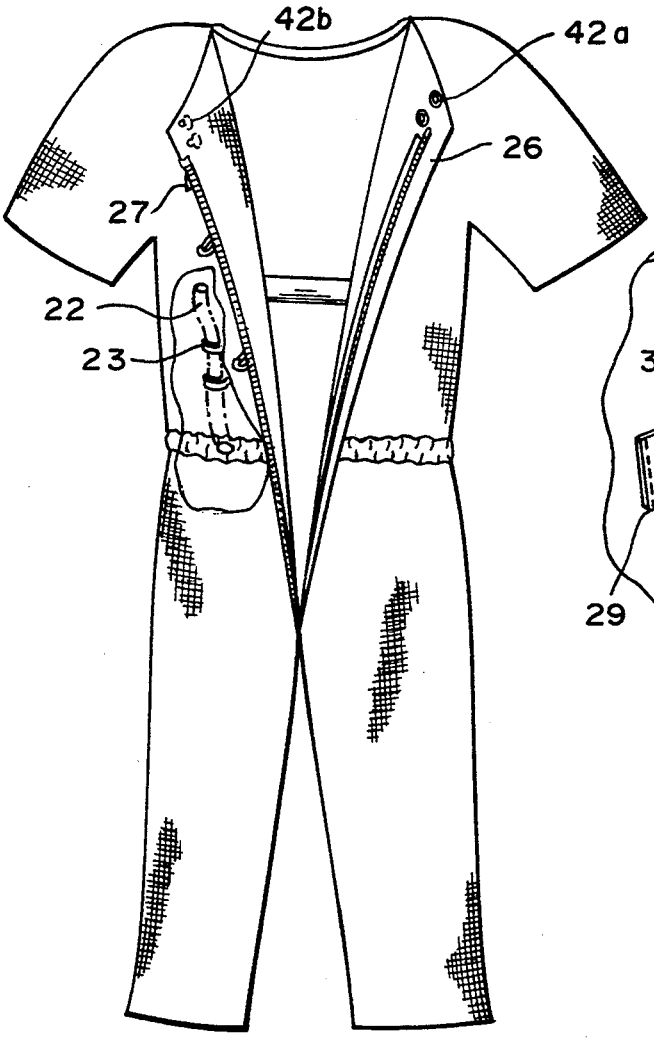
FIG. 5 is a rear view showing the garment opened.
Figure 6:
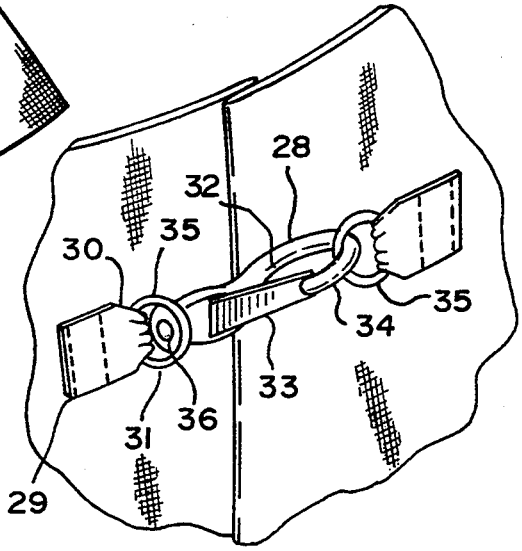
FIG. 6 is a partial enlarged view of the rear with the clasps.
Figure 7:
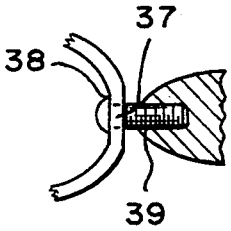
FIG. 7 is a detailed view of the clasp of FIG. 6.
Figure 8:
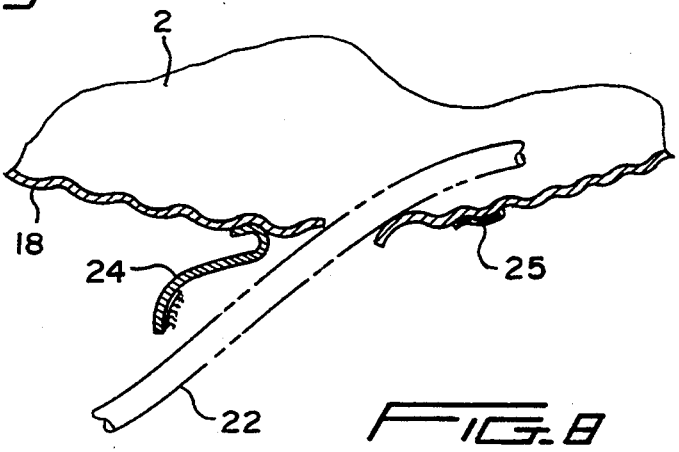
FIG. 8 is a plan view taken on line 8—8 of FIG. 1.

FIG. 1 shows a one piece non restraining garment 1 having an upper front body portion 2 including sleeves 3 for covering the arms. A lower body portion 4 includes closed leg portions 5 that extend down below the knees. Neck portion 6 has a reenforced seam as do all the sleeve and leg ends. Just below the neck is a detachable bib 7, which at the top conforms to the shape of the neckline. The bib contains a top plastic side and a fabric underside and extends partially down the chest. Around the periphery of the fabric sides and bottom there is coated a pressure sensitive adhesive 8 which adheres to the garment. The adhesive can be covered with a peelable liner 9 which can be replaced over the adhesive when the bib is removed. Below the bib and to the side a pocket 10 can be stitched to the garment. The pocket can be fitted with a doubly bent piece of transparent plastic 11 wherein one bend is an inverted U that slides down over the top edge of the pocket, whereas the other bend serves a repository for a nameplate 12. Below the pocket and above the waistline is an elongated sheath 13 sewn into the underside of the front of the garment. The sheath has a slit 14 at one end to receive a pair of straps 15. The straps would be used in the event the patient is incontinent and needs to wear a diaper. Since the garment is loose fitting except at the waistline, there is the possibility that the diaper would slip. Both ends of the straps would have a pressure sensitive adhesive 16 covered with a peelable liner 17. In use one end after removal of the liner would be pressed against the part of the sheath that extends inwardly from the garment and the other end would be joined in the region where the diaper strap is fastened to the diaper. In this manner not only would the diaper be secured but the strap extending from the sheath would keep the diaper from slipping down. The sheath might hold other accessories as well, such as toilet tissues or medication. At the waistline there is a gathered band 18 which is stitched on the top and bottom of the band. The band extends all around the garment and has enclosed strips of elastic 19 at spaced intervals in the band. This band provides a snug but adjustable fit at the waist. In the seam of the band and in a region absent the elastic strips there is a rectangular slot 20. Directly behind the slot in the garment is a circular opening 21 just large enough so that a catheter tube 22 can pass through it and lodge in the slot. The tube emanates from an implanted catheter site located in the chest wall. Above the opening in the garment are two spaced loops 23 stitched into the garment for containing the descending tube. The loops prevent random movement of the tube, but at the same time are wide enough so as to afford the tube some slack. The tube in the slot is concealed by covering it with a flap 24 that is stitched at one end to the band and at the other has a covering of hook and loop material 25 which meshes with the same on the band to fasten the flap. Since the flap is of the same material and color as the rest of the garment and the tube is unobtrusive an inconspicuous, an elderly and/or incapacitated person would hardly be aware of its existence. The back of the garment is divided into two longitudinal segments 26 and adjacent each end of the segments in the central region is stitched a zipper fastener 27 such that when the zipper unites the segments, one edge of the segment extends over the other edge to conceal the underlying fastener. The zipper extends downwardly from a region below the neck to the crotch. This arrangement enables easy access for personnel to remove the garment or reach into the front to procure the aforementioned straps from the sheath. Placed over the zipper on the outer side of the rear and close to the neck part is a ring clasp 28. The clasps are secured by patches 29 stitched on each side of the garment with respect to the center. The patches include two pieces folded over to form a loop 30 through which are passed metal rings. The rings are first passed through one of the pieces, the ends of which beyond the loop are stitched to the garment. Secured to one of the rings 31 is a metal clasp 32 which disconnects from one of the rings by pressing a spring blade 33 inwardly that allows a hook 34 on the clasp to separate from the ring. The other end of the clasp is secured to ring 35 by passing a threaded stud 36 through an aperture 37 in a flatted end 38 of the ring into a threaded opening 39 in the clasp. Optionally another clasp could be placed several inches below the first clasp. If desired, the clasp can be concealed by covering it with a strip of material 40 of the same type as the garment. The strip would have a section of hook and loop material 41, which would adhere to a similar section on the patch. In addition to using a clasp and a zipper, a pair of snap fastners can be used. These fasteners would be located at the longitudinal segments 26 and be aligned with the zipper but would start at about the neck line. They would comprise a female element **42*a* and a male element 42*b*** and like the zipper would be concealed when snapped together. Such an arrangement as described has been found to be a foolproof restraint against an individual's attempt to remove the garment. Even if an individual could somehow open the fastener and pull down the zipper, he would be impeded from opening the garment by virtue of the metal clasps.

The garment is made of a combination of cotton and poplin, is washable and has high thermal qualities. The sleeves can be short or long and the garment can be made in various colors with decorative designs.

While the invention is specifically designed for the aged and infirm who are confined to institutions or nursing homes, it doubtless could be adapted for others such as children where pulling off clothes can be a problem. The present invention as described above is susceptible to many modifications and variations within the ability of those skilled in the art and not requiring any inventive concepts. Therefore it is the intent of the appended claims to cover all such modifications and variations as may come within the spirit and scope of this invention.

I claim:

1. A one piece washable garment designed to prevent a wearer from removing said garment comprising:

a) a front part and a rear part, a neck portion and limb portions, said neck portion and said limb portions having reinforced ends, b) said front part being closed except for openings around the limbs and neck, said front part being defined by an upper section and a lower section, an adjustable waist band between said upper and lower section, said band extending around the circumference of said garment and having upper and lower ends, said ends being stitched to said garment, said band having elastic sections at spaced intervals therein, said band having a slot in an area free of elastic sections, an opening in said garment behind said slot just large enough to accommodate a catheter tube passing through and into said slot, said tube lodging in said slot and being concealed by a flap commensurate with the width dimension of said band, means for fastening said flap to said band, c) said garment having an underside and an elongate sheath stitched to said underside, said sheath being positioned between said neck portion and said waistband and being of a size to accommodate a pair of straps, said sheath having a slit at one end for insertion of said straps, d) said back part of said garment being divided into two segments, one of which overlaps the other, second fastening means stitched underneath said segments in the region where one segment overlaps the other, said fastening means extending from just below the neck region to the crotch.

2. A garment as in claim 1 is made of a combination of cotton and poplin and wherein said catheter tube descends from an implant site located above said opening in said waistband, said tube passing through a pair of spaced loops above said opening stitched to the underside of said garment, said loops containing said tube but having enough slack to allow some freedom of movement, said means for fastening said flap comprising stitching said flap at one end to said waist band and having hook and loop material at the other end which meshes with hook and loop material on said band.

3. A garment as in claim 1 wherein said second fastening means in said rear part of the garment includes a zipper underneath said segments and a clasp on the outer side of said garment over said overlapping segments, said clasp being located in the neck region.

4. A garment as in claim 3 wherein there are a pair of spaced clasps, one of said pair being located in the region of the back, said clasps including stitched patches on each side of said segments, said patches being folded over and stitched together and to said garment to form a loop for securing metal rings on each of said sides, said rings being inserted on said loop before said patches are stitched together, a metal clasp member having a hook and spring blade for engaging said one of said rings, said clasp member having a threadable stud for engaging a threaded aperture in said other metal ring said other ring being inserted on said loop before said patches are stitched together.

5. A garment as in claim 4 wherein two pairs of snap fasteners are located in alignment with and above said zipper, each one of said pairs comprising a female element located at an outer side of said longitudinal segment and a male element located at the inner side of said longitudinal segment.

6. A garment as in claim 1 wherein said garment has a pocket on said upper front part, said pocket having a transparent plastic doubly bent clip, wherein one bend is in the form of an inverted U-clip for slipping down over an edge of said pocket and said other bend forms a repository for holding a name plate, and a detachable bib having a top part configured to the shape of the neck portion and having an upper plastic layer and a lower fabric layer, said lower layer being coated with a pressure sensitive adhesive around its periphery for fastening said bib to said garment, said adhesive being covered with a peelable liner when not in use.

7. A garment as in claim 1 wherein said garment is loose fitting except in the region of the waist band wherein said stitching and said elastic strips therein produces a tight fit.

8. A garment as in claim 1 wherein said straps are coated at their respective ends with a pressure sensitive adhesive and a peelable liner when not in use, said straps serving to support a diaper by fastening one end of said straps to said sheath and the other end to said diaper in the region where the diaper is normally fastened.

9. A garment as in claim 4 wherein said spaced clasps are concealed by a strip of garment material, said strip having ends with a small piece of hook and loop material at said ends which mates with corresponding hook and loop material on said patches.

* * * * *